United States Patent [19]

Wallach

[11] 4,164,319

[45] Aug. 14, 1979

[54] TOY CASH REGISTER

[75] Inventor: Ira Wallach, New York, N.Y.

[73] Assignee: Durham Industries, Inc., New York, N.Y.

[21] Appl. No.: 937,346

[22] Filed: Aug. 28, 1978

[51] Int. Cl.[2] ..... G06C 27/00

[52] U.S. Cl. ..... 235/1 E; 235/12

[58] Field of Search ..... 235/1 E, 12, 23

[56] References Cited

U.S. PATENT DOCUMENTS

| | | | |
|---|---|---|---|
| 1,651,477 | 12/1927 | Shipley | 235/23 |
| 1,761,643 | 6/1930 | Shipley | 235/23 |
| 1,804,650 | 5/1931 | Shipley | 235/23 |
| 1,815,453 | 7/1931 | Shipley | 235/130 R |
| 1,901,097 | 3/1933 | Green | 235/23 |
| 2,458,850 | 1/1949 | Hardick | 235/12 |
| 3,045,901 | 7/1962 | Allen | 235/23 |
| 3,957,198 | 5/1976 | Thomson | 235/12 |

FOREIGN PATENT DOCUMENTS

| | | | |
|---|---|---|---|
| 991998 | 5/1965 | United Kingdom | 235/1 E |

*Primary Examiner*—Stephen J. Tomsky
*Attorney, Agent, or Firm*—Wolder, Gross & Yavner

[57] ABSTRACT

A toy cash register for displaying sales amount indicia including a plurality of corresponding indicia legs, which when manipulated cause a sales amount indicia display to be shown at the top of the register. The actuation mechanism for translating the above manipulation into a display includes a lower leg portion for each leg which defines a pawl mateable with a corresponding rotatable holding cam, each holding cam defining a cam opening for mating with the pawl. A spring biases the holding cam in a clockwise rotational direction and each such cam controls motion of a display indicia arm connected to a sales amount indicia display. A charging button operates to control a rotatable charging arm pivoted on the frame of the register to move all of the holding cams in a counter-clockwise direction so as to mate the cam opening and the pawl for all holding cams, the mating relationship being selectively disengaged by manipulation of a selected indicia leg to cause a corresponding display of the sales amount indicated on the leg. A cash drawer and a cash register tape are also included for selective manipulation in connection with use of the register. A ringing feature is included in the invention, so that as each indicia leg rises, it causes a trigger to contact and vibrate a ringing bar to indicate the display of a sales amount, similar to an actual cash register.

8 Claims, 7 Drawing Figures

TOY CASH REGISTER

This invention relates to toy cash registers and more particularly to toy cash registers of the type which are adapted to indicate amounts of money in response to button manipulation, thereby to simulate a real cash register used by business establishments.

Toy cash registers have been on the market for a number of years, and many have adapted to mass production capabilities within the toy industry. Mass production techniques in the toy industry have significantly revolutionized the business, especially in view of the advent of plastics and plastic molding techniques. It is now the object of every toy manufacturer to include as many plastic molded parts as possible in order to cut down the risk of breakage, in order to lower manufacturing costs and in order to simplify assembly techniques.

Such considerations are extremely important in the toy business because of the low margin of profit and because damage to an articulating mechanism requires replacement of the complete toy rather than repair of the mechanism, so inexpensive plastic, rather than metal helps the problem.

The task of transforming a manipulation of a cash register button to a display of sales amount information at the top of the cash register is a problem which has received varying treatment by the designers of toy mechanisms. Extremely complex mechanisms have been used, with many moving parts which could only be made in some cases by use of metal rather than plastic materials.

It is therefore an object of the present invention to provide a toy cash register which includes mainly plastic parts and which is simple and yet efficient in the accomplishment of its intended function.

A further and more particular object is to provide an articulating mechanism for a cash register which features essentially a four piece mechanism for translating motion of a manipulated button to display of corresponding amount information.

It is a further object of the present invention to provide an improved toy cash register which may be easily assembled or otherwise fabricated of mostly plastic material.

These and other objects of the present invention are accomplished in a preferred embodiment of the present invention which features a toy cash register for displaying sales amount indicia. The register includes a cash register frame, a display panel defining panel amount openings and a panel charging opening, indicia legs extending through the panel amount openings and including upper and lower leg portions, release hold pawls upwardly extending from each of the lower leg portions, a display indicia arm for each of the legs with each arm defining an indicia of an amount corresponding to indicia on the corresponding indicia leg. The display indicia amounts for each arm are shown at the top of the cash register and the display indicia amounts for each leg are shown through the panel amount openings. A rotatable charging cam is pivoted on the frame and movable by motion of a charging button to operate a plurality of rotatable holding cams, one for each leg and the holding cams defining a cam opening for mating with one of the pawls. A spring biases each of the holding cams in a clockwise rotation direction with the charging cam movable by means of the charging button to rotate the charging cam in a counter-clockwise direction to cause the mating between cam openings of the holding cams and corresponding pawls. Manipulation of the indicia legs releases the mating relationship for the holding cam and lower leg portion related thereto, with the said spring action, causing the display at the top of the cash register. A second spring also biases the charging cam in a clockwise direction so as to remove the charging cam from its operative position after each action of the charging button, and to give the charging button "feed".

The toy cash register also includes a cash drawer and a tape display, as well as a ringing feature.

Other objects, features and advantages of the present invention will become more apparent by reference to the following more detailed description of a preferred, but nonetheless illustrative, embodiment of the present invention with reference to the accompanying drawings, wherein.

Figure 1:
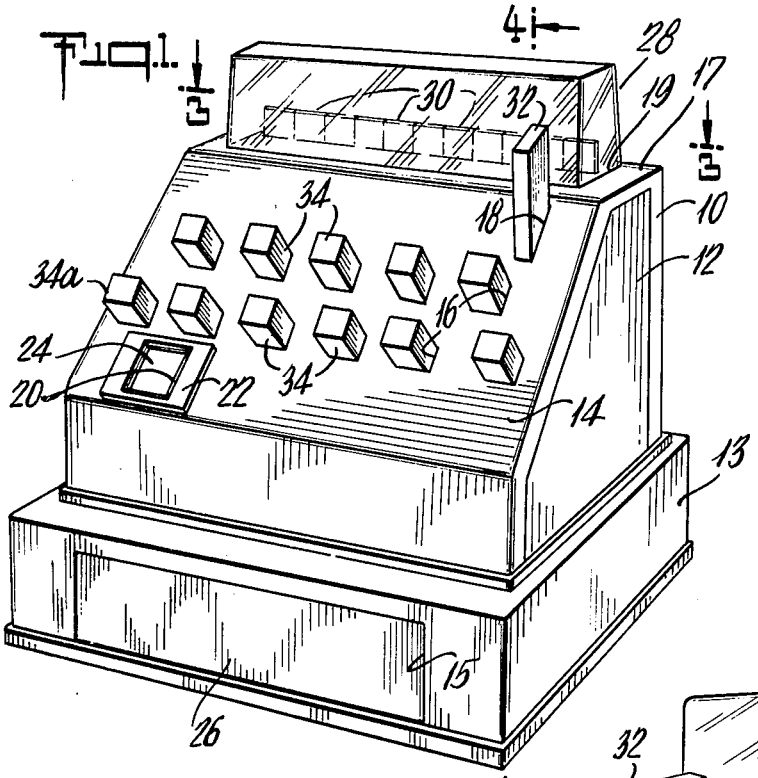
FIG. 1 is an isometric representation of a toy cash register according to the present invention, showing particularly the indicia buttons of a display panel and display indicia arms showing the sales amounts corresponding to the buttons.
Figure 2:
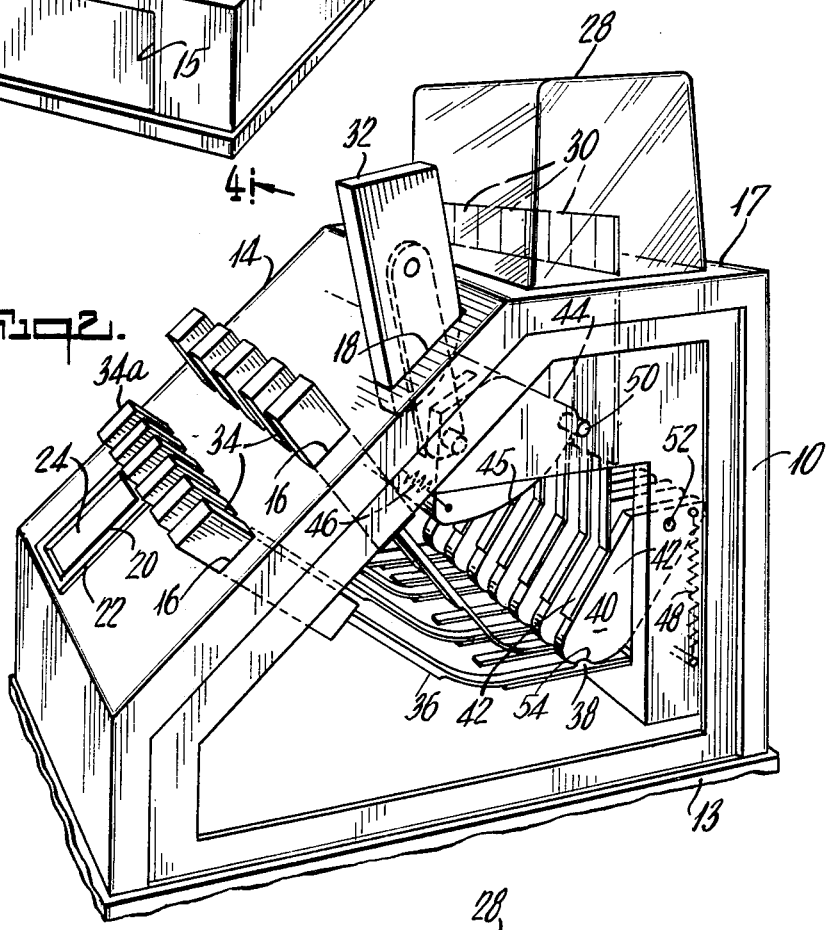
FIG. 2 is another, side isometric view of the present invention showing particularly the action of the charging button therefor.
Figure 3:
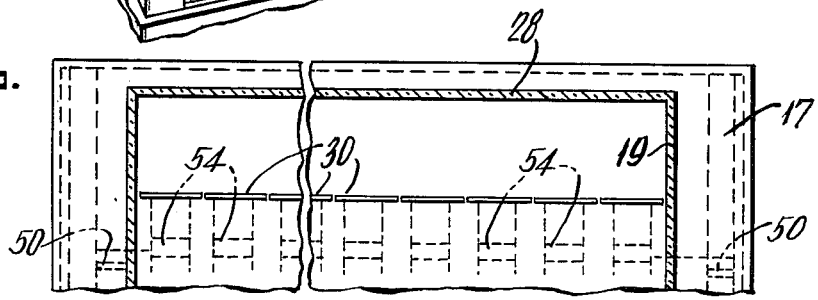
FIG. 3 is a top sectional view taken along the line 3—3 of FIG. 1 and showing particularly the display indicia arms at the top of the cash register for displaying sales amounts as determined by selection of indicia buttons at the front of the toy cash register.
Figure 4:
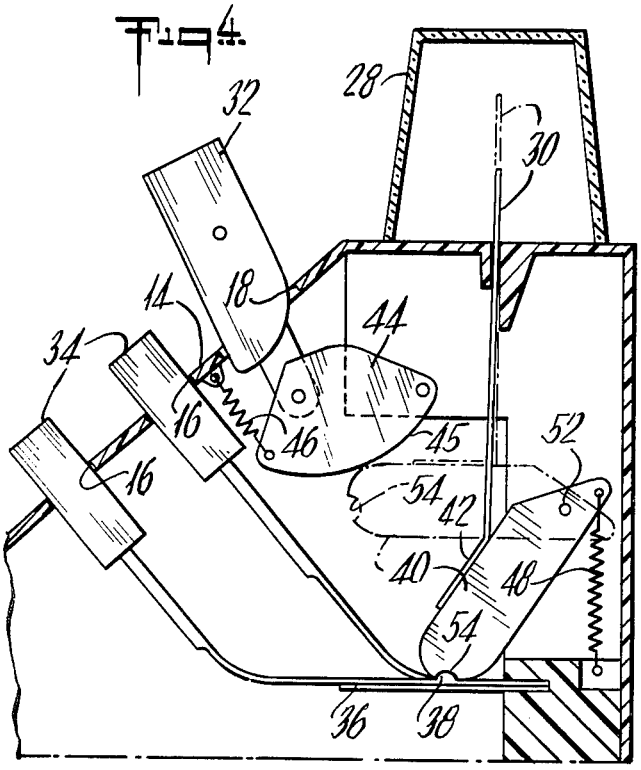
FIG. 4 is a side sectional view taken along the line 4—4 of FIG. 1 and showing particularly the mechanism for operating the toy cash register sales amount display, with the holding cams and lower leg portion pawls in mating relationship.
Figure 5:
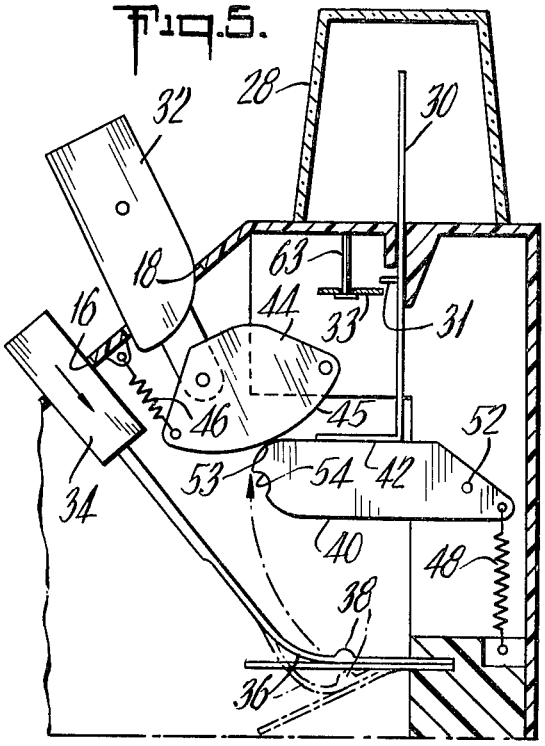
FIG. 5 is a view similar to that of FIG. 4, but showing the holding cam-pawl relationship released by action of the indicia buttons at the upper leg portions and showing the ringing feature mechanism.
Figure 7:
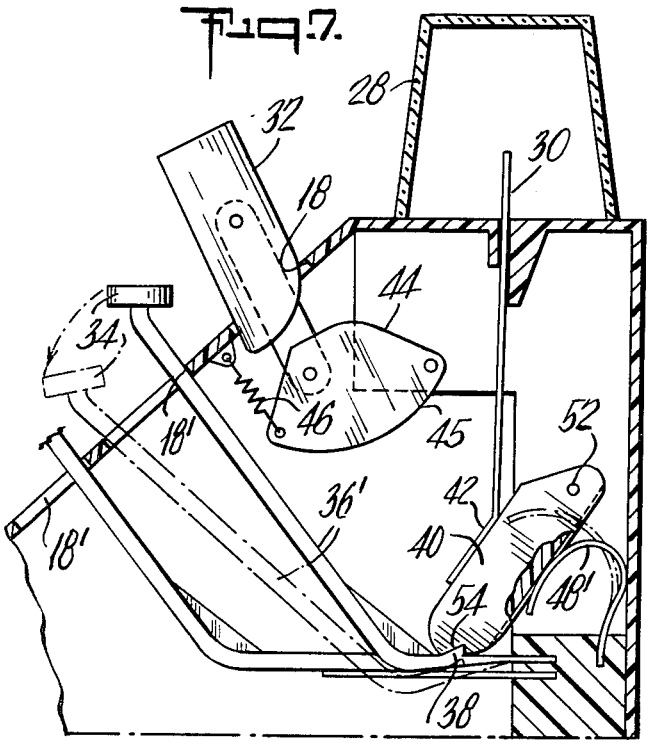
Figure 6:
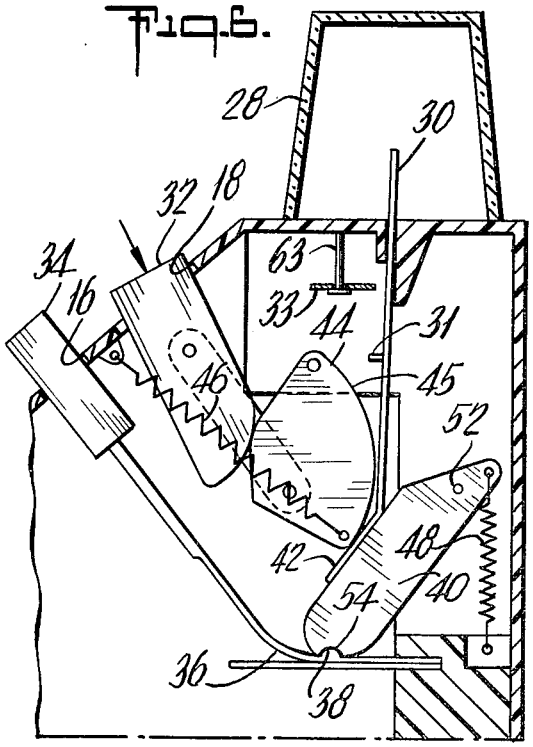

FIG. 6 is a view similar to that of FIGS. 4 and 5, but showing the action of the charging button in causing again the mating relationship between the holding cam and pawl as in FIG. 4; and FIG. 7 is a view similar to that of FIG. 4, but showing an alternative embodiment wherein the upper and lower leg portions were rigid with respect to each other rather than flexible as in the preferred embodiment.

Referring to the drawings, the toy cash register of the present invention includes a frame 10 (including various sub-frames fixed with respect to the frame) of standard construction which is finished by means of a side cover 12 to close the frame opening on each side of the cash register. The base 13 of the cash register defines a drawer opening 15 into which is slidably inserted a drawer 26, as with full-sized cash register construction. By standard mechanism means the drawer has a ringing feature (not shown).

The finishing of the toy cash register is also accomplished by means of display panel 14 which defines panel amount openings 16, through which protrude a plurality of indicia buttons 34. Each indicia button 34 displays on its most exposed face either an amount of money or a "no sale" display. For instance, exposed face **34*a* displays "no sale", and the other indicia buttons display an amount of money, varying in range from 1¢ to $15.00, or whatever amounts might suit the particular needs of the construction. Display panel 14 defines a tape display opening 20 framed by tape display 22, into which is inserted a paper tape 24 for simulating a printed record of the particular transaction which might be performed on the present construction. Furthermore, display panel 14 defines panel charging opening 18, through which protrudes charging button 32** whose function will be particularly described hereinafter.

Top panel 17 of the present invention defines a top opening 19, through which protrudes a plurality of display indicia arms 30, each displaying near its uppermost point amounts or other indicia also displayed by indicia buttons 34. Such display indicia arms 30 are enclosed by a suitable display housing 28 which simulates a transparent dust protector usually found on full-sized cash registers.

The mechanism of the present invention is more particularly described with reference to FIGS. 2 through 7, wherein a charging cam 44, in the form of an elongated cam having a curved camming surface 45, is mounted in the cash register by means of axle 50, which is rotatably mounted with respect to frame 10. Alternatively, charging cam 44 may be elongated and generally flat, conforming to the camming surface 45 shown in the second sheet of drawings. Thus, significant material may be saved with a full charging cam 44 only used at the point of construction where a connection is made with charging button 32. Using the right side viewing orientation of FIG. 2 as a reference, charging cam 44 is biased by spring 46 in the clockwise direction, spring 46 being suitably mounted at its free end to frame 10 or display panel 14 (or a sub-frame). The upper surface of charging cam 44 is rotatably attached to charging button 32, so that a downward motion of charging button 32 produces a counter-clockwise rotation of charging cam 44 about its charging cam axle 50.

Furthermore, display indicia arms 30 extend downwardly into the toy cash register, terminating in flexibly attached display indicia arm base 42. Display indicia arm bases 42 are attached to a holding cam 40 which is rotatable by means of main axle 52 suitably affixed with respect to the construction. Holding cams 40 are biased for clockwise rotation by means of springs 48, also suitably attached with respect to the construction frame or a sub-frame at the free ends of such springs. The lower surface of each holding cam 40 defines a cam opening 54 for mating with a hold pawl 38 of an indicia leg according to the following description:

Indicia buttons 34 extend into the toy cash register for attachment to indicia legs 36, each of which defines at its upper surface the previously mentioned hold pawl 38 for mating relationship with a holding cam opening 54.

Referring particularly to FIG. 4, the initial position of the mechanism is shown with each holding cam 40 having its defined holding cam opening 54 mated with a hold pawl 38. At this point, spring 48 is extended, spring 46 is holding charging cam 44 at a point of fullest extent with respect to clockwise rotation, charging button 32 is at its point of fullest protrusion through panel charging opening 18, indicia buttons 34 each at its point of fullest protrusion through associated panel amount opening 16 and display indicia arms 30 are at their lowest point within display housing 28. At this initial position, when an indicia button 34 is manually pushed into opening 16, indicia leg 36 will move downwardly in the orientation of FIG. 4, thereby releasing the particular hold pawl 38 associated with the indicia leg attached to the indicia button 34 which had been pushed. By the action of spring 48, holding cam 40, whose cam opening 54 is associated with the hold pawl 38, actuated, rotates in a clockwise direction (arrow 49 of FIG. 5). Thus, (FIG. 5) the motion of an indicia button 34 in direction 35 for a particular holding cam 40, releases the mating relationship of cam opening 54 and hold pawl 38. The lower surface 53 of holding cam 40 for that cam thereby abuts surface 45 of charging cam 44. It may also be seen from FIG. 5 that display indicia arm 30 rises to its fullest extent within display housing 28. Thus, an amount is displayed on the particular display indicia arm involved, which is equivalent to the amount or indicia displayed by the indicia button 34 involved in the operation.

Of course, as many indicia buttons 34 as an operator desires may be pressed at any one time or sequentially, thus raising to a display position a plurality of display indicia arms 30 as may correspond thereto. The display indicia arms 30 that have been raised by the operation are held in the raised position.

As each display indicia arm 30 is raised (FIG. 5), a trigger 31 contacts and vibrates a ringing bar 33, which is held in place by a strut 63 and which bar is made of metal, or the like, in order to ring when vibrated.

Release of the display associated with the raised display indicia arms 30 that have been selected is provided by means of overcoming the actions of spring 48, spring 46 and the combination of trigger 31 and ringing bar 33. More specifically, (FIG. 6), pressing of charging button 32 moves the charging cam in a counter-clockwise direction overcoming the action of spring 46, thereby causing counter-clockwise rotation of as many holding cams 40 as had been released from hold pawls 38 by the previously described selection process for display. The force provided to the mechanism is sufficient thereby to overcome both spring 48 and trigger 31 to lower display indicia arms 30 to the initial position of FIG. 4. Hold pawl 38 is then mated again with cam opening 54 for all holding cams 40 of the mechanism.

An alternative embodiment of the present invention is shown in FIG. 7 wherein a non-flexible, unitary indicia leg 36' is used for each amount display, with each indicia leg defining an upwardly facing hold pawl 38 for action in restraining holding cams 40 as previously described. Furthermore, the mechanism of FIG. 7 includes a leaf spring 48' for biasing cams 40 in a clockwise rotation orientation in place of the previously described spring 48. In the modification of FIG. 7, the defined panel charging openings 18 of display panel 14 are replaced with a series of elongated slots 18' for presenting a simulation of a more archaic cash register than the toy cash register described with respect to FIGS. 1 through 6.

In order to present a complete description of the present invention, a series of use and operational steps will now be particularly described with reference to the preferred embodiment of FIGS. 1 through 6. As with a full-sized cash register, the child or adult operating the toy simulates a transaction, which costs the play purchaser a certain amount of money. Assuming this amount to be $3.75, the toy operator presses the indicia buttons bearing indicia adding up to the $3.75 amount. For purposes of this description, it will be assumed that one of the indicia buttons bears the $3.00 indication and another bears a 75¢ indication. These two indicia buttons are then pressed, causing the lowering of corresponding indicia legs 36, which in turn release the corresponding two cam openings 54 and hold pawls 38. The associated two holding cams 40 are thereby rotated in the clockwise direction about main axle 52 to lift corresponding display indicia arms 30 within display housing 28, one of such display indicia arms displaying the amount "$3.00" and the other displaying the amount "75¢". Each indicia arm causes a ring of ringing bar 33 as it rises, because of the action of trigger 31 on each arm.

In order to ready the mechanism for the next simulated transaction, the operator presses charging button 32 to thereby overcome the bias of spring 46 and to rotate elongated charging cam 44 (extending the full width of the mechanism). The rotation of charging cam 44 in the counter-clockwise direction causes camming surface 45 to bear against all holding cams 40 which have been raised, as previously described. Thus, the two holding cams 40 which had been raised to display $3.75 will be rotated in the counter-clockwise direction until all cam openings 54 again mate with associated pawls 38. This, of course, lowers the previously raised display indica arms to their initial position as shown in FIGS. 4 and 6. The toy cash register is then ready for its next operation.

It may be seen that the modified mechanism of FIG. 7 is similarly operated but with indicia buttons 34 tilted in the direction of indicating arrow 61, rather than pressed in order to accomplish the release of hold pawl 38 from holding cam 40.

What is claimed is:

1. A toy cash register for displaying sales amount indicia comprising a cash register frame, a display panel defining panel amount openings and a panel charging opening, indicia legs extending through said panel amount openings and including upper and lower leg portions, hold pawls upwardly extending from each of said lower leg portions, a display indicia arm for each of said legs with each arm defining an indicia of an amount corresponding to indicia on the corresponding indicia leg and displayed through its said panel amount opening, a charging button extending through said panel charging opening, a rotatable charging cam pivoted on said frame and movable by motion of said charging button, a plurality of rotatable holding cams each defining a cam opening for mating with one of said hold pawls and a spring biasing each of said holding cams in a clockwise rotation all constructed and arranged whereby depression of the upper portion of one of said indicia legs releases its said lower portion by lowering its pawl from its corresponding said cam opening and said spring causes clockwise rotation of said holding cam, each of said display indicia arms contacting one of said holding cams so that a clockwise rotation of a holding cam lifts one of said arms to display an indicia of an amount corresponding to indicia on the corresponding, depressed indicia leg.

2. The invention, according to claim 1, wherein said charging cam is biased for clockwise rotation by a second spring affixed to said frame and attached to said charging cam base proximate its free surface.

3. The invention, according to claim 1, wherein said register further includes a charging cam axle about which said charging cam rotates.

4. The invention, according to claim 1, wherein said register further includes an elongated panel charging opening and said depression of said indicia legs defines a tilting motion for said legs.

5. The invention, according to claim 1, wherein said register further includes a main axle rotatable with respect to said frame about which said holding cams rotate.

6. The invention, according to claim 1, wherein said upper and lower leg portions are attached by means of a flexible connection.

7. The invention, according to claim 1, wherein said upper and lower leg portions are rigidly attached.

8. The invention, according to claim 1, wherein said toy cash register further comprises an elongated ringing bar, rigid with respect to said cash register frame and triggers protrude from each of said indicia arms for contacting and vibrating said ringing bar as each arm is lifted.

* * * * *